United States Patent [19]

Jehn et al.

[11] 4,170,964

[45] Oct. 16, 1979

[54] WATER-TUBE BOILER

[75] Inventors: Thomas C. Jehn, Onalaska; Francis J. Roraff, La Crosse, both of Wis.; Gerald T. Bauers, Kansas City, Mo.

[73] Assignee: The Trane Company, La Crosse, Wis.

[21] Appl. No.: 923,503

[22] Filed: Jul. 10, 1978

[51] Int. Cl.[2] ..... F22B 37/24; F22B 21/30

[52] U.S. Cl. ..... 122/235 G; 122/336; 122/494; 122/510

[58] Field of Search ..... 122/235 G, 336, 478, 122/494, 510

[56] References Cited

U.S. PATENT DOCUMENTS

| | | | |
|---|---|---|---|
| 3,272,186 | 9/1966 | Lorenzini | 122/336 |
| 3,645,238 | 2/1972 | Suhs | 122/235 |
| 3,664,309 | 5/1972 | Seelinger | 122/336 |
| 3,971,345 | 7/1976 | Csathy | 122/336 |

OTHER PUBLICATIONS

"Central Station Boilers" Bulletin G74, published by The Babcock & Wilcox Company, 1954, pp. 52 to 57.

"Central Station Boilers" Bulletin G86, published by The Babcock & Wilcox Company, 1957, p. 49.

*Primary Examiner*—Kenneth W. Sprague

*Attorney, Agent, or Firm*—Carl M. Lewis; Peter D. Ferguson

[57] ABSTRACT

A water-tube boiler (1) of the "D" type is disclosed which includes a water-cooled rear wall comprising a plurality of vertically disposed riser tubes (14*a, b*) located at the rear end of the furnace chamber (5). Novel sealing means are disclosed for sealing the aforesaid rear wall to its adjacent vertically extending walls of the furnace chamber (5) and convection section (7). A further aspect of the invention lies in the particular feeder conduit means (9, 10, 11, 12, 13) provided for supplying water to the riser tubes of the water-cooled rear wall and also in the particular return conduit means (15*a, b;* 16*a, b*) provided for connecting the riser tubes (14*a, b*) to the steam drum (3). In yet another aspect of the invention, novel construction is provided associated with the convection section for discharging flue gases from the boiler.

21 Claims, 5 Drawing Figures

FIG. 4
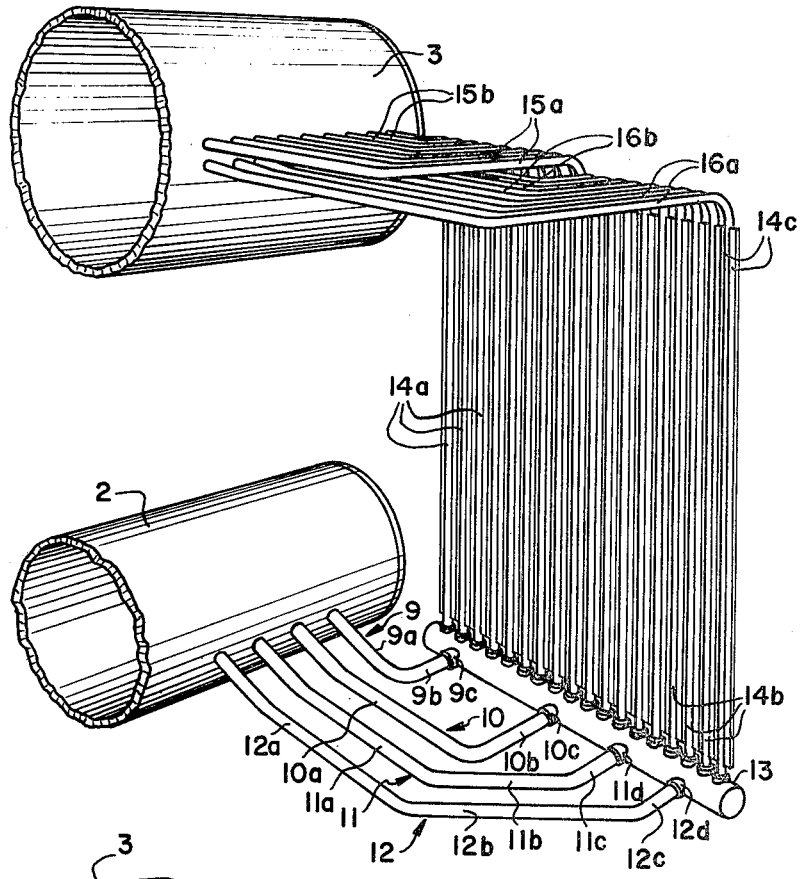
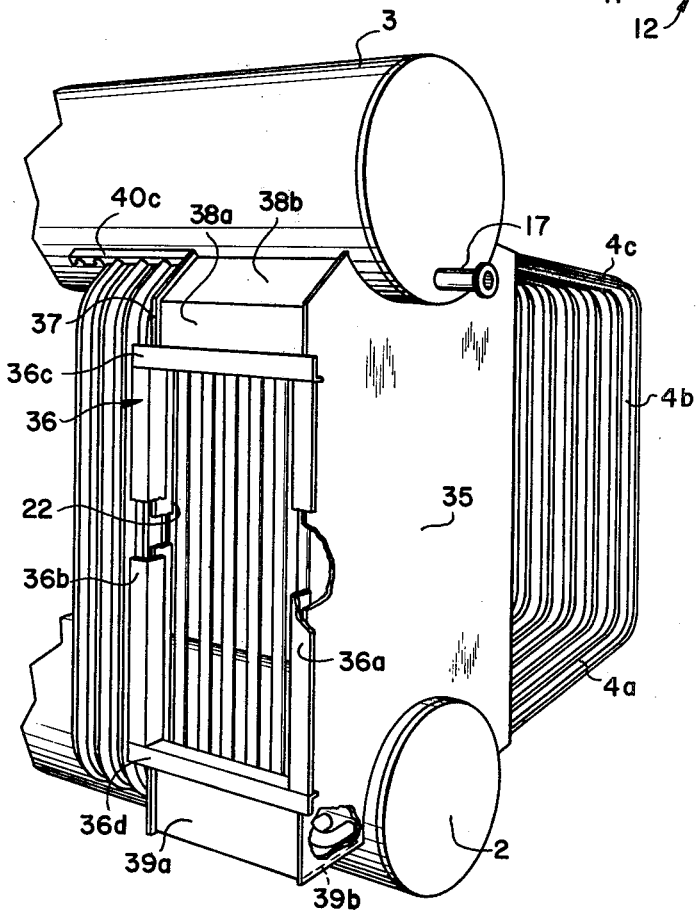
FIG. 5

WATER-TUBE BOILER

DESCRIPTION

1. Technical Field

The present invention relates to water-tube boilers of the "D"-type which find use in a variety of applications for the production of high pressure steam.

2. Background Art

The general configuration of water-tube boilers of the "D"-type is well known to those skilled in the art and, furthermore, such boilers have been provided in the past with water-cooled rear walls wherein a plurality of vertically extending tubes are provided at the rear end of the furnace chamber of the boiler. The present invention is directed to specific improvements in the sealing means used to prevent the escape of flue gases from the furnace chamber at those points where the water-cooled rear wall is adjacent thereto. Other improvements of the present invention include the novel feeder conduit means provided for supplying water to the rear wall and in the return conduit means connecting the upper ends of the riser tubes to the steam drum.

The flue gas outlet provided in the present invention, although located in the same general location as prior art flue gas outlets have been provided, includes a novel structural relationship with a front end wall of the convection section whereby improved sealing and structural rigidity are provided.

DISCLOSURE OF THE INVENTION

The water-tube boiler disclosed herein includes an elongated water drum disposed at a lower level and an elongated steam drum at an upper level in generally overlying relationship to the water drum. A furnace chamber is defined by a plurality of "C"-shaped tubes which extend between the aforementioned drums. Similarly, a convection section is defined immediately adjacent the furnace chamber by a plurality of convection tubes disposed in a two-dimensional array extending between the steam drum and water drum. A front end of the furnace chamber includes means for effecting combustion whereby products of combustion pass through the furnace chamber, into the convection section, and are discharged via a flue gas outlet located in an outer wall of the convection section.

Disposed at the rear end of the furnace chamber are a plurality of riser tubes extending generally vertically so as to define a planar tube wall extending across the rear end of the furnace chamber. The lengths of the riser tubes are such that they extend both above and below the extremeties of the furnace chamber, as defined by the aforementioned "C"-shaped tubes.

Novel sealing means are provided for sealing both the upper and lower junctions of the rear wall to horizontally extending portions of the "C"-shaped tubes defining the furnace chamber. Such sealing means include first and second serrated plate sealing means disposed at respective upper and lower portions of the riser tubes, one each of which is in sealing engagement with a serration of the respective serrated plate sealing means. First and second plate sealing means are in sealing engagement with second edge portions of the first and second serrated plate sealing means and extend therefrom to a position in sealing engagement with respective upper and lower walls of the furnace chamber. In this manner, a gas-tight seal is formed at the upper and lower edges of the rear furnace wall.

In order to seal the vertically extending junction between the rear wall and the vertical wall of the furnace chamber, vertically extending plate sealing means are provided extending therebetween and in cooperative relationship at their upper and lower ends with the aforementioned serrated plate sealing means.

Further novel sealing means are provided at the junction between the rear end of the convection section and the adjacent vertically extending edge of the rear wall of the furnace chamber. To this end, sixth plate sealing means extend vertically in a plane generally perpendicular to the longitudinal axes of the steam drum and water drum in sealing relationship with the rear ends thereof. Seventh plate sealing means extend vertically in a plane transverse to the aforementioned sixth plate sealing means, in sealing relationship with longitudinally extending rear end portions of the steam and water drums, a first vertically extending edge portion thereof being in sealing relationship with the aforementioned sixth plate sealing means and a second vertically extending edge portion thereof being in sealing relationship with the adjacent vertically extending edge portion of the rear wall.

The riser tubes of the water-cooled rear tube wall are supplied with water to be vaporized from a manifold disposed at lower ends thereof. In order to return vaporized water from the riser tubes to the steam drum, a first series of the riser tubes immediately adjacent the convection section extend to a first level above the upper wall of the furnace chamber and a second series of said tubes adjacent the first series extend vertically to a second level below the first level. Each riser tube includes a first portion extending generally horizontally toward the front end of the boiler and a second portion extending generally horizontally in a direction transverse to said first portion toward the steam drum and connected thereto. In this manner, the first and second portions of the riser tubes in each series lie in nested relationship, with the second portions of the riser tubes of the first series being in generally overlying relationship to the second portions of the riser tubes of the second series.

The aforementioned manifold which supplies water to the riser tubes of the rear tube wall is supplied itself with water by a plurality of feeder conduits extending between the water drum and the manifold. Said feeder conduits comprise at least first, second, and third feeder conduits, the second of which is longer than the first, and the third being longer than the second feeder conduit; the first, second and third feeder conduits are connected to the manifold at respective first, second, and third adjacent points spaced along the length thereof such that the distance between the first and second points is greater than the distance between the second and third points, whereby even distribution of water to the manifold and riser tubes is provided. In a preferred embodiment, four such feeder conduits are provided having a similar dimensional relationship.

A final aspect of the invention lies in the provision of combustion products outlet means for discharging products of combustion from the convection section. In this respect, frame means are provided which define an opening therethrough and which are adapted for connection to an exhaust stack. The frame means are in overlying relationship to a portion of the outermost row of the aforementioned convection tubes and which do not include fin means interconnecting adjacent ones thereof. The frame means include a vertically extending first edge portion in sealing engagement with and at least partially supported by a generally planar front end plate which seals at least the front end of the convection section.

Thus, it is an object of the present invention to provide a water-tube boiler of the "D"-type which includes a water-cooled rear tube wall having associated therewith novel sealing means, including serrated plate sealing means, for preventing the escape of combustion products from the furnace chamber.

A further and related object of the present invention lies in the provision of novel sealing means associated with the rear tube wall whereby its vertically extending edges are sealed with respect to the adjacent vertically extending wall of the furnace chamber and convection section, respectively.

A further object of the present invention is the provision of riser tubes having a three-dimensional configuration whereby respective first and second series thereof may be provided in nested relationship, with one of said series being in generally overlying relationship to the other said series.

A related object of the invention lies in specific feeder conduit means in order to supply water to the manifold disposed at the lower ends of the riser tubes which make up the rear tube wall, said feeder conduit means being designed and of a configuration so as to provide even water distribution over the entire length of the manifold.

A final object of the present invention lies in the provision of combustion products outlet means for discharging products of combustion from the convection section which include frame means having a vertically extending edge portion in sealing engagement with and at least partially supported by a generally planar front end plate of the convection section.

These and other objects of the present invention will become apparent hereinafter wherein the best mode for carrying out the invention is disclosed with reference to the appended drawings.

BRIEF DESCRIPTION OF DRAWINGS

FIG. 4 is a perspective view, also with certain elements removed, which illustrates with clarity the general arrangement of the rear tube wall and its associated feeder conduit means and return conduit means.

FIG. 5 is a further perspective view showing the details of the combustion products outlet means associated with the front end of the convection section of the boiler.

BEST MODE FOR CARRYING OUT THE INVENTION

Figure 1:
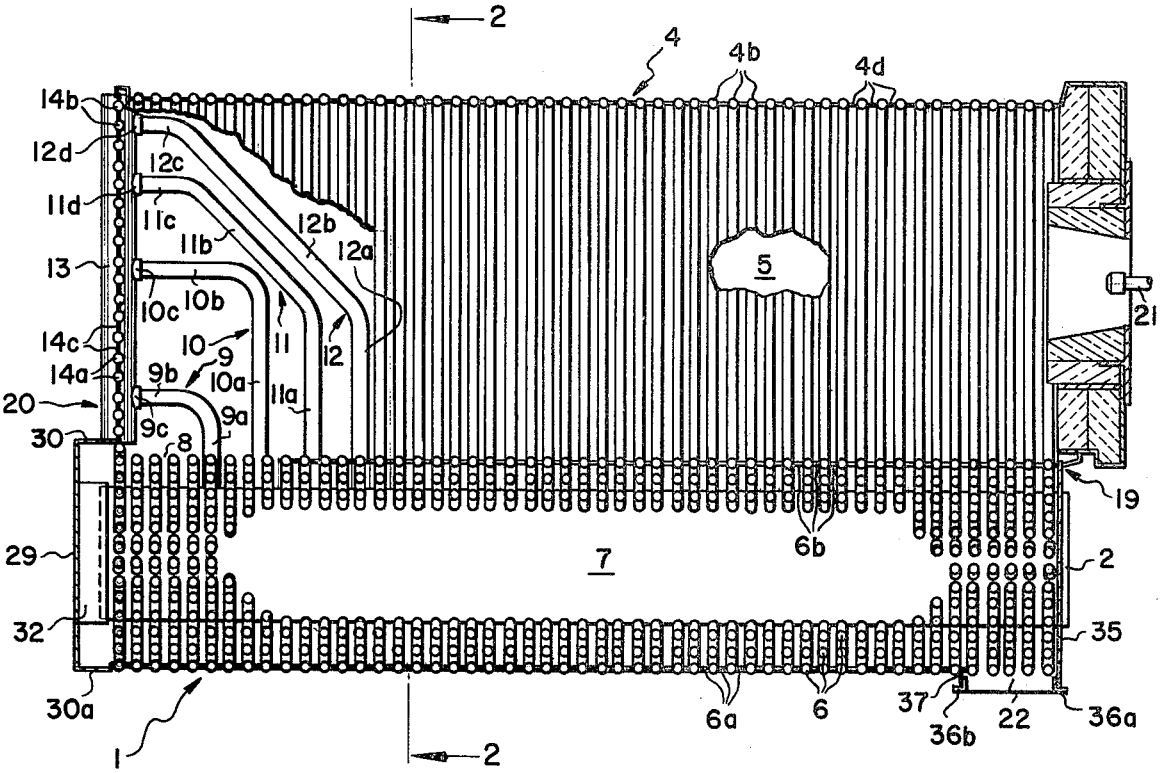
FIG. 1 is a view taken in cross-section along a horizontally extending planar of the boiler, as illustrated by the section line 1—1 of FIG. 2.
Figure 2:
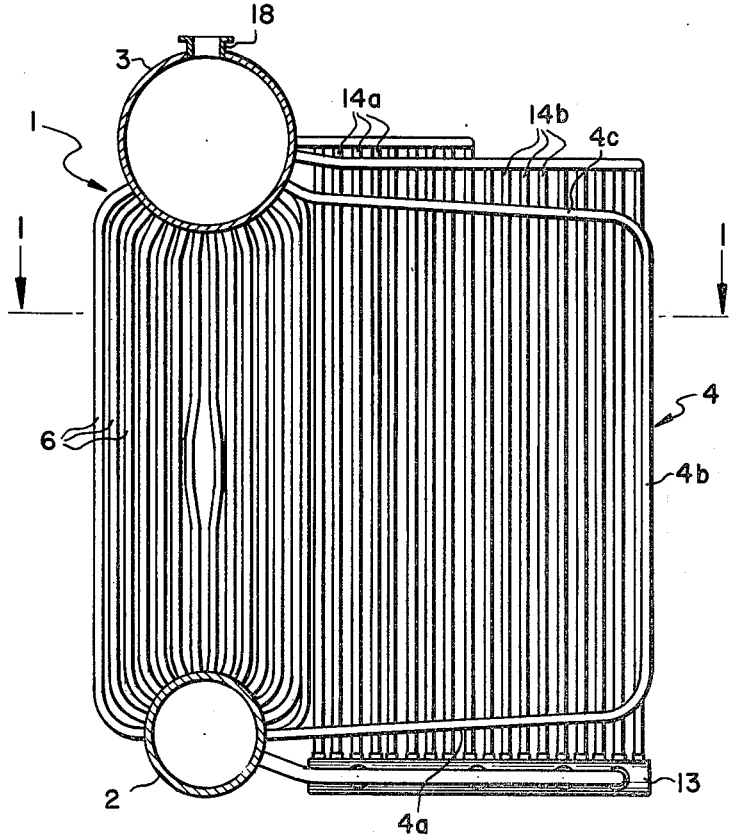
FIG. 2 is a second view taken in cross-section along the section line 2—2 of FIG. 1.

Turning now to FIGS. 1 and 2 of the drawings, the boiler of the present invention, indicated generally by reference numeral 1, will be described. As best seen in FIG. 2, an elongated water drum 2 is provided at a lower level and extends generally horizontally along a first longitudinal axis, one end thereof being disposed adjacent a front end of the boiler (indicated generally by reference numeral 19) the othere end of water drum 2 being disposed adjacent a rear end thereof (as indicated generally by reference numeral 20). Disposed at an upper level above the aforesaid lower level is an elongated steam drum 3 which extends generally horizontally along a second longitudinal axis substantially parallel to the first longitudinal axis of the water drum. As is evident from FIG. 2, steam drum 3 is in generally overlying relationship to water drum 2.

A plurality of generally "C"-shaped tubes are connected between the water drum and steam drum and include a lower leg portion **4*a* connected to the water drum and extending generally horizontally therefrom in a direction transverse to the first longitudinal axis of the water drum; a bight portion 4*b* extending generally vertically to a level substantially equal to the upper level of steam drum 3; and an upper leg portion 4*c* extending generally horizontally in a direction transverse to the second longitudinal axis of the steam drum and connected thereto. As best seen in FIG. 1, the plurality of "C"-shaped tubes are disposed in generally parallel, side-by-side relationship and include fin means 4*d* interconnecting adjacent ones thereof so as to define an elongated enclosed furnace chamber extending along a longitudinal axis generally parallel to the first and second longitudinal axis, the furnace chamber being identified generally by reference number 5**.

A convection section 7 is disposed immediately adjacent furnace chamber 5 and includes a plurality of convection tubes 6 which extend generally vertically (see FIG. 2) between water drum 2 and steam drum 3. As best seen in FIG. 1, the convection tubes are arranged in a two-dimensional array extending along the first and second longitudinal axes and also in a direction transverse thereto. It should further be noted that the outermost longitudinally extending row of convection tubes 6 include fin means **6*a* interconnecting adjacent ones thereof so as to enclose the outer wall of the convection section. Similarly, fin means 6*b* comprise means for separating convection section 7 and furnace chamber 5 along a portion of their lengths while defining adjacent the rear ends thereof a flow passage 8**, the function of which will be described hereinafter.

Disposed adjacent the rear end of furnace chamber 5 is structure which defines a water-cooled rear tube wall for the boiler, as most clearly illustrated in FIGS. 1, 2, and 4. Such structure includes feeder conduit means comprising first through fourth feeder conduits 9, 10, 11, and 12; and a manifold 13 disposed adjacent the rear end of the furnace chamber at a level below the lower leg portions **4*a* of "C"-shaped tubes 4 and extending generally horizontally in a direction transverse to the first longitudinal axis of water drum 2**.

A plurality of riser tubes **14*a* and 14*b* extend vertically from manifold 13 to a level above upper leg portions 4*c* of the "C"-shaped tubes, said riser tubes being disposed in generally parallel, side-by-side relationship so as to define a planar tube wall extending across the rear end of furnace chamber 5. As best seen in FIGS. 1 and 4, fin means 14*c* are provided interconnecting adjacent ones of riser tubes 14*a*, *b*, so as to enclose the rear end of furnace chamber 5**.

As seen in FIG. 4, return conduit means **15*a*, *b* and 16*a*, *b* are provided for connecting riser tubes 14*a* and 14*b*, respectively, to steam drum 3**.

As shown in FIG. 5, the front end of steam drum 3 includes means for admitting water to be vaporized to the boiler in the form of an inlet connection 17. As is known to those skilled in the art, water flow proceeds within boiler 1 from water drum 2 into the lower leg portions 4*a* of "C"-shaped tubes 4, the lower ends of a first portion of convection tubes 6, and into feeder conduit means 9, 10, 11, 12, and 13; and into riser tubes 14*a, b;* whereby at least a portion of said water is vaporized while passing through said tubes and exits therefrom into the steam drum 3. As illustrated in FIG. 2, means are provided for withdrawing said vaporized water from steam drum 3 in the form of a flanged outlet connection 18. It will further be appreciated by those skilled in the art that, depending upon the particular operating conditions of the boiler at a particular time, a portion of convection tubes 6 will serve as downcomers to return unvaporized water from the steam drum 3 to water drum 2.

As illustrated in FIG. 1 and as will be discussed in more detail hereinafter front and rear wall means are provided for enclosing the respective front and rear ends of the furnace chamber and convection section of boiler 1.

Also illustrated in FIG. 1 are means 21 for effecting combustion within furnace chamber 5 whereby heat is transferred to "C"-shaped tubes 4, to those convection tubes 6 disposed adjacent furnace chamber 5, and to riser tubes 14*a, b.* The resulting products of combustion then pass via flow passage 8 into convection section 7 wherein heat is transferred to the remainder of convectin tubes 6, the combustion products being discharged from convection section 7 via combustion products outlet means 22.

Figure 3:
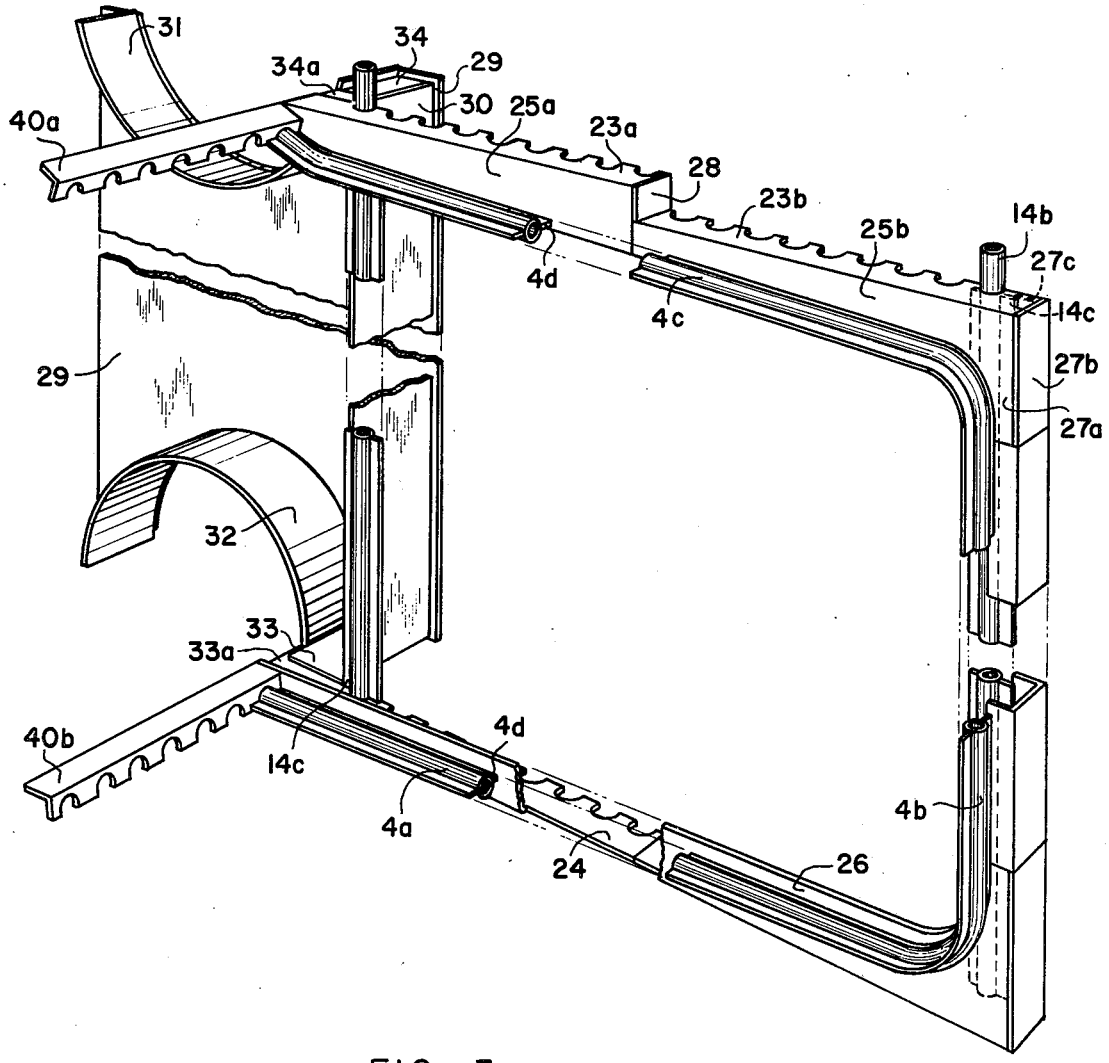
FIG. 3 is a perspective view, partially cut away and with certain elements left out for the sake of clarity, of the sealing means associated with the rear tube wall of the boiler.

Turning now to FIG. 3 of the drawings, the rear wall means associated with the rear end of the furnace chamber 5 for providing sealing thereof will be described.

First serrated plate sealing means 23*a, b* are disposed at a level above upper leg portion 4*c* of "C"-shaped tubes 4 and include a first edge portion having a plurality of serrations, each of riser tubes 14*a, b* being in sealing engagement with one of said serrations. Extending vertically from a second edge portion of serrated plate sealing means 23*a, b* are first plate sealing means 25*a, b* which extend therefrom to a position in sealing engagement with the upper wall of furnace chamber 5 as defined by upper leg portion 4*c* of "C"-shaped tubes 4. In the preferred embodiment, the rearmost "C"-shaped tube of furnace chamber 5 includes fin means 4*d* extending rearwardly therefrom for engagement with first plate sealing means 25*a, b.*

In the preferred embodiment, first serrated plate sealing means 23*a* and 23*b* comprise separate plate members disposed at different levels and interconnected by a connecting plate means 28. Similarly, first plate sealing means 25*a* and 25*b* comprise separate plates following the general configuration of first serrated plate sealing means 23*a, b.* As will become apparent hereinafter, this configuration is preferred due to the specific configuration chosen for the riser tubes which comprise the rear tube wall. It should thus be noted that the first serrated plate sealing means and first plate sealing means could comprise a respective single planar plate members without departing from the scope of the present invention. As illustrated, first serrated plate sealing means 23*a,* 23*b* and first plate sealing means 25*a,* 25*b,* respectively, are formed from single pieces of sheet material, such as steel, by bending such sheet at about a 90° angle. It will be appreciated, however, that a welded construction could be employed wherein elements 23*a,* 25*a* and 23*b,* 25*b,* respectively, comprise separate plates welded together along their common edges.

Turning now to the lower edge portion of the rear tube wall, it will be seen that second serrated plate sealing means 24 are provided for at a level below the lower leg portions 4*a* of "C"-shaped tubes 4 and include a first edge portion having a plurality of serrations with each of the riser tubes 14*a, b* being in sealing engagement with one thereof. Second plate sealing means 26 are provided in sealing engagement with a second edge portion of second serrated plate sealing means 24 and extends therefrom to a position in sealing engagement with the lower wall of furnace chamber 5 as defined by the lower leg portions 4*a* of "C"-shaped tubes 4. Once again, fin means 4*d* are provided extending rearwardly from the last "C"-shaped tube of the furnace chamber for engagement with second plate sealing means 26.

Looking now at the vertically extending edge of the rear tube wall which is adjacent the vertical wall of furnace chamber 5, as defined by bight portions 4*b* of "C"-shaped tubes 4, it is apparent that vertically extending plate sealing means are provided extending therebetween. In one preferred embodiment as illustrated in FIG. 3, the vertically extending plate sealing means comprise third, fourth, and fifth plate sealing means 27*a,* 27*b,* and 27*c,* respectively. Thus, fifth plate sealing means 27*c* includes a first edge portion in sealing engagement with fin means 14*c* of the outermost vertically extending riser tube 14*b,* and a second edge portion in sealing engagement with fourth plate sealing means 27*b.* Fourth plate sealing means 27*b,* in turn, includes a second edge portion in sealing engagement with third plate sealing means 27*a,* which extends therefrom to a position in sealing engagement with the vertical wall of furnance chamber 5, as defined by bight portion 4*b* of the rearmost "C"-shaped tube 4.

Looking at the rear tube wall sealing structure defined above, it may be seen that a generally rectangular box is formed to seal the planar tube wall with respect to the end of furnace chamber 5. It will be appreciated by those skilled in the art that the aforementioned sealing members are suitably welded in position so as to define fluid-tight joints at those points where they are in sealing relationship or engagement with other elements of the boiler structure. This type sealed joint is preferable to one utilizing plastic refractory-type material packed at such joints as has been used in prior art boiler designs.

It should be further pointed out that, although the vertically extending plate sealing means specifically illustrated includes the aforementioned third, fourth, and fifth plate sealing means, it is within the scope of the present invention that a single vertically extending plate be substituted therefore if the spatial relationship between the end riser tube and adjacent "C"-shaped tube were such as to permit that arrangement.

Turning now to the rear end of convection section 7 and its junction with the rear tube wall, the novel sealing structure associated therewith will be described primarily by reference to FIG. 3.

As seen in FIG. 3, a first cylindrical plate member 31 is provided which conforms to at least a portion of the outer cylindrical surface of steam drum 3 so as to be in sealing engagement therewith. Similarly, a second cylindrical plate member 32 is provided having a shape which conforms with at least a portion of the outer cylindrical surface of water drum 2. Extending vertically between the axial ends of cylindrical plate members 31 and 32, in sealing relationship with the rear ends of water drum 2 and steam drum 3, is sixth plate sealing means 29 which lies in a plane generally perpendicular to the longitudinal axis of the respective steam and water drums.

Seventh plate sealing means 30 extend vertically in a plane transverse to the plane of sixth plate sealing means 29 in sealing relationship with the rear, longitudinally extending end portions of steam drum 3 and water drum 2, such sealing relationship being provided by filler plate members 33, 33*a*, and 34, 34*a* which extend between respective cylindrical plate members 32 and 31 and the lower and upper edge portions of seventh plate sealing means 30. The vertically extending edge portions of seventh plate sealing means 30 are in sealing engagement with the adjacent vertically extending edge portion of sixth plate sealing means 29 and with the innermost riser tube 14*a* of the rear tube wall, which riser tube includes fin means 14*c* extending therefrom for engagement with seventh plate sealing means 30.

As shown in FIG. 1, the remaining vertical edge portion of sixth plate sealing means 29 is maintained in sealing relationship with the outermost row of convection tubes by a further vertically extending plate sealing member 30*a*.

Turning now to FIG. 4 of the drawings, consideration will be given to the specific configuration of the structure going to make up the water-cooled rear tube wall of the boiler.

As is apparent from FIG. 4, a first series of riser tubes 14*a* are disposed immediately adjacent convection section 7 and extend vertically to a first level above upper leg portions 4*c* of "C"-shaped tubes 4. A second series of riser tubes 14*b* are disposed immediately adjacent first series 14*a* and extend vertically to a second level above upper portions 4*c* of "C"-shaped tubes 4, but below the aforesaid first level.

The return conduit means connecting the riser tubes 14*a, b* to steam drum 3 comprise each riser tube 14*a* of the first series including a first portion 15*a* extending generally horizontally toward the front end of boiler 1 and a second portion 15*b* extending generally horizontally in a direction transverse to the longitudinal axis of steam drum 3 and connected thereto. Similarly, each riser tube 14*b* of the second series includes a first portion 16*a* extending generally horizontally toward the front end of boiler 1 and a second portion 16*b* extending generally horizontally in a direction transverse to the longitudinal axis of steam drum 3 and connected thereto.

Since the first and second portions of the riser tubes of each of the first and second series are parallel to one another and of increasing length within each series in a direction away from convection section 7, the first and second portions of the riser tubes in each series lie in nested relationship as is clearly illustrated in FIG. 4. Further, since the riser tubes of the first series extend vertically to a level above that of the second series, the second portions of the riser tubes of the first series may be arranged in generally overlying relationship to the second portions of the riser tubes of the second series, thereby resulting in a compactly arranged configuration.

Although, in the embodiment illustrated, the riser tubes of first series 14*a* extend to a level above that of second series 14*b*, it is within the scope of the invention that riser tubes of second series 14*b* could extend to the higher level such that portions 16*b* thereof lie in overlying relationship to portions 15*b* of the first series.

The lower ends of riser tubes 14*a* and 14*b* are connected to a manifold 13 as previously described which receives water to be vaporized from water drum 2 via individual feeder conduits 9, 10, 11, and 12. It is critical that riser tubes 14*a* and 14*b* each be provided with a sufficient water supply so as to prevent tube "burn-out", while retaining efficient heat transfer and vaporization within the rear tube wall. Thus, it is very important that an even distribution of water be provided to manifold 13 such that each riser tube receives the proper amount of water.

To provide the above-described even distribution to manifold 13, first, second, third, and fourth feeder conduits 9, 10, 11, and 12, respectively, are provided as shown best in FIG. 4. It may be noted that first and second feeder conduits 9 and 10 each include a first portion 9*a* and 10*a*, respectively, extending generally horizontally from water drum 2 in a direction transverse to the longitudinal axis of water drum 2; and a second portion 9*b* and 10*b*, respectively, extending also generally horizintally but in a direction parallel to said axis and connected to manifold 13 at respective first and second points 9*c* and 10*c*, respectively.

Similarly, third and fourth feeder conduits 11 and 12, respectively, are provided, each having respective first portions 11*a* and 12*a* extending generally horizontally from water drum 2; respective second portions 11*b* and 12*b* extending also generally horizontally but in a direction at an angle with respect to the longitudinal axis of water drum 2; and respective third portions 11*c* and 12*c* extending also horizontally but in a direction parallel to the longitudinal axis of water drum 2 and connected to manifold 13 at respective third and fourth points 11*d* and 12*d*.

As may be clearly seen in FIG. 4, the first through fourth feeder conduits 9 through 12, respectively, are of increasing length with respect to one another. In order to compensate for the variable flow characteristics exhibited by feeder conduits of varying length, applicants have found it necessary to vary the spacing of first through fourth points 9*c*, 10*c*, 11*d*, and 12*d* along manifold 13 in order to assure adequate and even distribution of water to manifold 13. Thus, the distance between points 9*c* and 10*c* is greater than that between points 10*c* and 11*d*; and the distance between points 10*c* and 11*d* is greater than that between points 11*d* and 12*d*.

As mentioned previously, a further novel aspect of the present invention lies in the provision of combustion products outlet means for discharging products of combustion from convection section 7. As best illustrated in FIG. 5, a front end plate 35 is provided in overlying, sealing relationship with respect to at least the front end of convection section 7. As seen in FIG. 1, front end plate 35 is in sealing engagement about its periphery with fin means 6*b* extending forwardly from the innermost end convection tube 6, and at its upper and lower ends with the respective outer peripheries of steam drum 3 and water drum 2. Frame means indicated generally by reference numeral 36 are provided in overlying relationship to a portion of the outermost row of convection tubes 6 disposed adjacent the front end of convection section 7. As seen in FIGS. 1 and 5, these convection tubes do not include fin means interconnecting adjacent ones thereof so as to permit the passage of combustion products therebetween. Frame means 36 include a vertically extending first edge portion 36a in sealing engagement with and at least partially supported by front end plate 35.

Frame means 36 further include a vertically extending second edge portion 36b spaced from and generally parallel to first edge portion 36a. Second edge portion 36b is in sealing engagement with a first plate member 37 which extends vertically between steam drum 3 and water drum 2 in sealing engagement with and supported by fin means 6a of the adjacent outermost convection tube 6. Thus, edge portions 36a and 36b are sealed with respect to convection section 7.

Frame means 36 include generally horizontally extending third and fourth edge portions 36c and 36d which extend between respective upper and lower ends of the aforementioned vertically extending first and second edge portions 36a and 36b, respectively. A second plate member 38a, 38b is provided which extends between the outer periphery of steam drum 3 and upper, horizontally extending edge portion 36c of the frame means, to thereby seal the upper portion of the frame means with respect to the convection section.

In similar fashion, a third plate member 39a, 39b is provided which extends between the outer periphery of water drum 2 and the lower horizontally extending edge portion 36d of frame means 36, to thereby seal the lower portion thereof with respect to convection section 7.

Although second and third plate members 38a, b and 39a, b are illustrated as comprising two separate planar members being fastened together as by welding, it is within the scope of the invention that such plate members could comprise a single plate member having been bent to the appropriate configuration. As in the case with the other sealing means disclosed with respect to the present invention, those associated with the combustion products outlet means are suitably welded to one another and to the boiler itself in order to assure a positive gas-tight seal.

As will be apparent to those skilled in the art, frame means 36 is adapted for connection to an exhaust stack of conventional configuration through the use of fastening means such as bolts, welding, or the like.

It should further be pointed out that further serrated sealing means are associated with the boiler of the present invention in the form of elements 40a, 40b (see FIG. 3) and 40c (see FIG. 5) which serve to seal upper or lower ends of the convection tubes and "C"-shaped tubes at the points where they enter the appropriate steam or water drum.

It should now be appreciated to those skilled in the art that applicants have provided a water tube boiler of the "D"-type which includes a water-cooled rear tube wall and which utilizes suitable plate-type sealing means in lieu of packed, plastic refractory materials in order to prevent gas leaks from the furnace chamber 5 or convection section 7. Such construction is highly desirable in terms of constructing a boiler having a long, reliable life span relatively free from maintenance.

It will be further appreciated by those skilled in the art that a suitable outer sheet metal casing would be provided for the boiler, which casing has not been illustrated in the present drawings since it is conventional, and for the sake of clarity in illustrating the novel features of the present invention.

While the invention has been described with respect to a preferred embodiment, it is to be understood that modifications thereto will become apparent to those skilled in the art, which modifications lie within the scope of the present invention, as defined in the claims which follow.

We claim:

1. A water-tube boiler comprising:

a. an elongated water drum disposed at a lower level and extending generally horizontally along a first longitudinal axis, one end of said water drum being disposed adjacent a front end of said boiler, the other end being disposed adjacent a rear end thereof;

b. an elongated steam drum disposed at an upper level above said lower level and extending generally horizontally along a second longitudinal axis substantially parallel to said first longitudinal axis, said steam drum being in generally overlying relationship to said water drum;

c. a plurality of generally C-shaped tubes each having a lower leg portion connected to said water drum and extending generally horizontally therefrom in a direction transverse to said first longitudinal axis, a bight portion extending generally vertically to a level substantially equal to said upper level, and an upper leg portion extending generally horizontally in a direction transverse to said second longitudinal axis toward said steam drum and connected thereto; said plurality of C-shaped tubes being disposed in generally parallel, side-by-side relationship and including fin means interconnecting adjacent ones thereof so as to define an elongated, enclosed furnace chamber extending along a longitudinal axis generally parallel to said first and second longitudinal axes;

d. a plurality of convection tubes, each connected to and extending generally vertically between said steam drum and said water drum, said convection tubes being arranged in a two dimensional array extending along said first and second longitudinal axes and in a direction transverse thereto so as to define an elongated convection section adjacent said furnace chamber; the outermost, longitudinally extending row of said convection tubes including fin means interconnecting adjacent ones thereof so as to enclose said convection section; further comprising means for separating said convection section and said furnace chamber along a portion of their lengths while defining adjacent the rear ends thereof a flow passage therebetween;

e. structure disposed adjacent the rear end of said furnace chamber comprising i. feeder conduit means disposed adjacent the rear end of said furnace chamber at a level below the lower leg portions of said C-shaped tubes and connected to said water drum;

ii. a plurality of riser tubes connected to said feeder conduit means and extending generally vertically therefrom to a level above the upper leg portions of said C-shaped tubes, said riser tubes being disposed in generally parallel, side-by-side relationship so as to define a planar tube wall extending across the rear end of said furnace chamber and including fin means interconnecting adjacent ones thereof so as to enclose the rear end of said furnace chamber; and iii. return conduit means disposed above the upper leg portions of said C-shaped tubes connecting said riser tubes to said steam drum;

f. means for admitting water to be vaporized to said boiler for flow from said water drum into the lower leg portions of said C-shaped tubes, the lower ends of a first portion of said convection tubes and into said feeder conduit means and riser tubes, whereby at least a portion of said water is vaporized while passing through said tubes and exits therefrom into said vaporized water from said steam drum; a second portion of said convection tubes serving as downcomers to return unvaporized water from said steam drum to said water drum;

g. front and rear wall means for enclosing the respective front and rear ends of said furnace chamber and convection section;

h. means for effecting combustion within said furnace chamber whereby heat is transferred to said C-shaped tubes, to those convection tubes disposed immediately adjacent said furnace chamber and to said riser tubes, the resulting products of combustion passing via said flow passage and through said convection section wherein heat is transferred to said convection tubes; further comprising combustion products outlet means for discharging products of combustion from said convection section;

wherein the improvement comprises i. said rear wall means including structure for sealing said planar tube wall with respect to the rear end of said furnace chamber comprising i. first serrated plate sealing means disposed at a level above the upper leg portions of said C-shaped tubes including a first edge portion having a plurality of serrations, each of said riser tubes being in sealing engagement with one of said serrations; and a second edge portion;

ii. second serrated plate sealing means disposed at a level below the lower leg portions of said C-shaped tubes including a first edge portion having a plurality of serrations, each of said riser tubes being in sealing engagement with one of said serrations, and a second edge portion;

iii. first and second plate sealing means in sealing engagement with the second edge portions of said first and second serrated plate sealing means, respectively, and extending therefrom to a position in sealing engagement with respective upper and lower walls of said furnace chamber, as defined by the upper and lower leg portions of said C-shaped tubes, whereby the upper and lower ends of said planar tube wall are sealed with respect to the upper and lower walls of the rear end of said furnace chamber.

2. The water-tube boiler of claim 1 wherein the structure for sealing said planar tube wall with respect to the rear end of said furnace chamber further includes vertically extending plate sealing means extending between the vertically extending edge of said tube wall adjacent the vertical wall of said furnace chamber, as defined by the bight portions of said C-shaped tubes; and the vertical wall of said furnace chamber, whereby the vertically extending edge of said tube wall adjacent said vertical wall of said furnace chamber is sealed with respect to said vertical wall of the rear end of said furnace chamber.

3. The water-tube boiler of claim 2 wherein said vertically extending plate sealing means comprise a. fifth plate sealing means having a first edge portion in sealing engagement with the vertically extending edge of said tube wall adjacent the vertical wall of said furnace chamber, as defined by the bight portions of said C-shaped tubes, and a second edge portion, b. fourth plate sealing means having a first edge portion in sealing engagement with the second edge portion of said fifth plate sealing means and a second edge portion;

c. third plate sealing means having a first edge portion in sealing engagement with the second edge portion of said fourth plate sealing means and a second edge portion in sealing engagement with said vertical wall of said furnace chamber, whereby the vertically extending edge of said tube wall adjacent said vertical wall of said furnace chamber is sealed with respect to said vertical wall of the rear end of said furnace chamber.

4. The water-tube boiler of claim 3 wherein the vertically extending edge of said tube wall in sealing engagement with the first edge portion of said fifth plate sealing means comprises fin means extending from the end riser tube of said tube wall.

5. The water-tube boiler of claim 1 wherein the rear C-shaped tube of said furnace chamber includes fin means extending rearwardly therefrom defining said upper and lower walls of said furnace chamber in sealing engagement with said first and second plate sealing means.

6. The water-tube boiler of claim 1 wherein said first and second serrated plate sealing means lie in generally horizontal planes and extend from their respective serrated edge portions toward the front end of said furnace chamber, terminating in said second edge portions; and wherein said first and second plate sealing means lie in generally vertical planes, extending between said second edge portions and the respective upper and lower walls of said furnace chamber.

7. The water-tube boiler of claim 1 wherein a. a first series of said riser tubes disposed immediately adjacent said convection section extend vertically to a first level above the upper leg portions said C-shaped tubes and a second series of said riser tubes disposed immediately adjacent said first series extend vertically to a second level above the upper portions of said C-shaped tubes but below said first level; and b. said first serrated plate sealing means comprise a first serrated plate member having its serrations in sealing engagement with the first series of said riser tubes and a second serrated plate member having its serrations in sealing engagement with the second series of said riser tubes, said first serrated plate member being disposed at a level above said second serrated plate member and connected thereto by connecting plate means.

8. A water-tube boiler comprising:

a. an elongated water drum disposed at a lower level and extending generally horizontally along a first longitudinal axis, one end of said water drum being disposed adjacent a front end of said boiler, the other end being disposed adjacent a rear end thereof;

b. an elongated steam drum disposed at an upper level above said lower level and extending generally horizontally along a second longitudinal axis substantially parallel to said first longitudinal axis, said steam drum being in generally overlying relationship to said water drum;

c. a plurality of generally C-shaped tubes each having a lower leg portion connected to said water drum and extending generally horizontally therefrom in a direction transverse to said first longitudinal axis, a bight portion extending generally vertically to a level substantially equal to said upper level, and an upper leg portion extending generally horizontally in a direction transverse to said second longitudinal axis toward said steam drum and connected thereto; said plurality of C-shaped tubes being disposed in generally parallel, side-by-side relationship and including fin means interconnecting adjacent ones thereof so as to define an elongated, enclosed furnace chamber extending along a longitudinal axis generally parallel to said first and second longitudinal axes;

d. a plurality of convection tubes, each connected to and extending generally vertically between said steam drum and said water drum, said convection tubes being arranged in a two dimensional array extending along said first and second longitudinal axes and in a direction transverse thereto so as to define an elongated convection section adjacent said furnace chamber; the outermost, longitudinally extending row of said convection tubes including fin means interconnecting adjacent ones thereof so as to enclose said convection section; further comprising means for separating said convection section and said furnace chamber along a portion of their lengths while defining adjacent the rear ends thereof a flow passage therebetween;

e. structure disposed adjacent the rear end of said furnace chamber comprising i. feeder conduit means disposed adjacent the rear end of said furnace chamber at a level below the lower leg portions of said C-shaped tubes and connected to said water drum;

ii. a plurality of riser tubes connected to said feeder conduit means and extending generally vertically therefrom to a level above the upper leg portions of said C-shaped tubes, said riser tubes being disposed in generally parallel, side-by-side relationship to as to define a planar tube wall extending across the rear end of said furnace chamber and including fin means interconnecting adjacent ones thereof so as to enclose the rear end of said furnace chamber; and iii. return conduit means disposed above the upper leg portions of said C-shaped tubes connecting said riser tubes to said steam drum;

f. means for admitting water to be vaporized to said boiler for flow from said water drum into the lower leg portions of said C-shaped tubes, the lower ends of a first portion of said convection tubes and into said feeder conduit, means and riser tubes, whereby at least a portion of said water is vaporized while passing through said tubes and exits therefrom and into said steam drum, further comprising means for withdrawing said vaporized water from said steam drum; a second portion of said convection tubes serving as downcomers to return unvaporized water from said steam drum to said water drum;

g. front and rear wall means for enclosing the respective front and rear ends of said furnace chamber and convection section;

h. means for effecting combustion within said furnace chamber whereby heat is transferred to said C-shaped tubes, to those convection tubes disposed immediately adjacent said furnace chamber and to said riser tubes, the resulting products of combustion passing via said flow passage and through said convection section wherein heat is transferred to said convection tubes, further comprising combustion products outlet means for discharging products of combustion from said convection section;

wherein the improvement comprises i. said rear wall means including structure for sealing said planar tube wall with respect to the rear end of said furnace chamber comprising i. first serrated plate sealing means comprising generally rectangular, planar, elongated, plate means having a plurality of serrations formed in a first elongated edge portion thereof, said plate means being disposed at a level above the upper leg portions of said C-shaped tubes and extending generally horizontally in a direction transverse to said second longitudinal axis from a point adjacent said steam drum, terminating in an end portion disposed adjacent the vertical wall of said furnace chamber as defined by the bight portions of said C-shaped tubes, each of said riser tubes being in sealing engagement with one of said serrations;

ii. second serrated plate sealing means comprising generally rectangular, planar, elongated plate means having a plurality of serrations formed in a first elongated edge portion thereof, said plate means being disposed at a level below the lower leg portions of said C-shaped tubes and extending generally horizontally in a direction transverse to said first longitudinal axis from a point adjacent said water drum terminating in an end portion disposed adjacent said vertical wall of said furnace chamber, each of said riser tubes being in sealing engagement with one of said serrations;

iii. fourth plate sealing means comprising generally rectangular, planar, elongated plate means extending generally vertically between and in sealing engagement with said end portions of said first and second serrated sealing means;

iv. first, second, and third plate sealing means comprising generally planar plate means extending from sealing engagement with the elongated, non-serrated edge portions of said first and second serrated plate sealing means and one elongated edge portion of said fourth plate sealing means to a position in sealing engagement with the upper, lower and vertical walls of said furnace chamber as defined by respective upper, lower, and bight portions of the C-shaped tubes defining said furnace chamber; and v. fifth plate sealing means comprising generally rectangular, planar, elongated plate means extending from sealing engagement with the other elongated edge portion of said fourth plate sealing means to a position in sealing engagement with the vertically extending edge of said tube wall adjacent said vertical wall of the furnace chamber, the upper and lower edge portions of said fifth plate sealing means being in sealing engagement with the serrated edge portions of the respective first and second serrated sealing means, whereby a generally rectangular box is formed to seal said planar tube wall with respect to the rear end of said furnace chamber.

9. A water-tube boiler comprising:

a. an elongated water drum disposed at a lower level and extending generally horizontally along a first longitudinal axis, one end of said water drum being disposed adjacent a front end of said boiler, the other end being disposed adjacent a rear end thereof;

b. an elongated steam drum disposed at an upper level above said lower level and extending generally horizontally along a second longitudinal axis substantially parallel to said first longitudinal axis, said steam drum being in generally overlying relationship to said water drum;

c. a plurality of generally C-shaped tubes each having a lower leg portion connected to said water drum and extending generally horizontally therefrom in a direction transverse to said first longitudinal axis, a bight portion extending generally vertically to a level substantially equal to said upper level, and an upper leg portion extending generally horizontally in a direction transverse to said second longitudinal axis toward said steam drum and connected thereto; said plurality of C-shaped tubes being disposed in generally parallel, side-by-side relationship and including fin means interconnecting adjacent ones thereof so as to define an elongated, enclosed furnace chamber extending along a longitudinal axis generally parallel to said first and second longitudinal axes;

d. a plurality of convection tubes, each connected to and extending generally vertically between said steam drum and said water drum, said convection tubes being arranged in a two dimensional array extending along said first and second longitudinal axes and in a direction transverse thereto so as to define an elongated convection section adjacent said furnace chamber, the outermost, longitudinally extending row of said convection tubes including fin means interconnecting adjacent ones thereof so as to enclose said convection section; further comprising means for separating said convection section and said furnace chamber along a portion of their lengths while defining adjacent the rear ends thereof a flow passage therebetween;

e. structure disposed adjacent the rear end of said furnace chamber comprising i. feeder conduit means disposed adjacent the rear end of said furnace chamber at a level below the lower leg portions of said C-shaped tubes and connected to said water drum;

ii. a plurality of riser tubes connected to said feeder conduit means and extending generally vertically therefrom to a level above the upper leg portions of said C-shaped tubes, said riser tubes being dispo-ed in generally parallel, side-by-side relationship so as to define a planar tube wall extending across the rear end of said furnace chamber and including fin means interconnecting adjacent ones thereof so as to enclose the rear end of said furnace chamber; and iii. return conduit means disposed above the upper leg portions of said C-shaped tubes connecting said riser tubes to said steam drum;

f. means for admitting water to be vaporized to said boiler for flow from said water drum into the lower leg portions of said C-shaped tubes, the lower ends of a first portion of said convection tubes and into said feeder conduits, manifold, and riser tubes, whereby at least a portion of said water is vaporized while passing through said tubes and exits therefrom into said steam drum, further comprising means for withdrawing said vaporized water from said steam drum; a second portion of said convection tubes serving as downcomers to return unvaporized water from said steam drum to said water drum;

g. front and rear wall means for enclosing the respective front and rear ends of said furnace chamber and convection section;

h. means for effecting combustion within said furnace chamber whereby heat is transferred to said C-shaped tubes, to those convection tubes disposed immediately adjacent said furnace chamber and to said riser tubes, the resulting products of combustion passing via said flow passage and through said convection section wherein heat is transferred to said convection tubes; further comprising combustion products outlet means for discharging products of combustion from said convection section;

wherein the improvement comprises i. said rear wall means including structure for sealing said tube wall with respect to the rear end of said convection section comprising i. sixth plate sealing means extending vertically in a plane generally perpendicular to said first and second longitudinal axes between the rear ends of said water and steam drums in sealing relationship therewith;

ii. seventh plate sealing means extending vertically in a plane transverse to the plane of said sixth plate sealing between the rear, longitudinally extending end portions of said water and steam drums in sealing relationship therewith, a first vertically extending edge portion of said seventh plate sealing means being in sealing relationship with said sixth plate sealing means and a second vertically extending edge portion thereof being in sealing relationship with the vertically extending edge portion of said tube wall adjacent said convection section.

10. The water-tube boiler of claim 9 wherein said water drum and steam drum are of generally cylindrical configuration and wherein a. a first cylindrical plate member is provided in sealing engagement with at least a portion of the outer cylindrical surface of said steam drum disposed adjacent the rear end of said convection section and including an axial edge portion;

b. a second cylindrical plate member is provided in sealing engagement with at least a portion of the outer cylindrical surface of said water drum disposed adjacent the rear end of said convection section and including an axial edge portion; and c. said sixth plate sealing means is in sealing engagement with the axial edge portions of said first and second cylindrical plate members and said seventh plate sealing means is in sealing relationship with the outer cylindrical surfaces of said first and second cylindrical plate members.

11. The water-tube boiler of claim 10 wherein said first and second cylindrical plate members are in sealing engagement with at least those rear end portions of said respective steam and water drums which are exposed to the interior of said convection section, said sixth plate sealing means being in sealing engagement with the axial edge portions of said first and second cylindrical plate members so as to enclose the rear end of said convection section.

12. A water-tube boiler comprising:

a. an elongated water drum disposed at a lower level and extending generally horizontally along a first longitudinal axis, one end of said water drum being disposed adjacent a front end of said boiler, the other end being disposed adjacent a rear end thereof;

b. an elongated steam drum disposed at an upper level above said lower level and extending generally horizontally along a second longitudinal axis substantially parallel to said first longitudinal axis, said steam drum being in generally overlying relationship to said water drum;

c. a plurality of generally C-shaped tubes each having a lower leg portion connected to said water drum and extending generally horizontally therefrom in a direction transverse to said first longitudinal axis, a bight portion extending generally vertically to a level substantially equal to said upper level, and an upper leg portion extending generally horizontally in a direction transverse to said second longitudinal axis toward said steam drum and connected thereto; said plurality of C-shaped tubes being disposed in generally parallel, side-by-side relationship and including fin means interconnecting adjacent ones thereof so as to define an elongated, enclosed furnace chamber extending along a longitudinal axis generally parallel to said first and second longitudinal axex;

d. a plurality of convection tubes, each connected to and extending generally vertically between said steam drum and said water drum, said convection tubes being arranged in a two dimensional array extending along said first and second longitudinal axes and in a direction transverse thereto so as to define an elongated convection section adjacent said furnace chamber, the outermost, longitudinally extending row of said convection tubes including fin means interconnecting adjacent ones thereof so as to enclose said convection section; further comprising means for separating said convection section and said furnace chamber along a portion of their lengths while defining adjacent the rear ends thereof a flow passage therebetween;

e. structure disposed adjacent the rear end of said furnace chamber comprising i. feeder conduit means disposed adjacent the rear end of said furnace chamber at a level below the lower leg portions of said C-shaped tubes and connected to said water drum;

ii. a plurality of riser tubes connected to said feeder conduit means and extending generally vertically therefrom to a level above the upper leg portions of said C-shaped tubes, said riser tubes being disposed in generally parallel, side-by-side relationship and including fin means interconnecting adjacent ones thereof so as to enclose the rear end of said furnace chamber; and iii. return conduit means disposed above the upper leg portions of said C-shaped tubes connecting said riser tubes to said steam drum.

f. means for admitting water to be vaporized to said boiler for flow from said water drum into the lower leg portions of said C-shaped tubes, the lower ends of a first portion of said convection tubes and into said feeder conduit means and riser tubes, whereby at least a portion of said water is vaporized while passing through said tubes and exits therefrom into said steam drum, further comprising means for withdrawing said vaporized water from said steam drum; a second portion of said convection tubes serving as downcomers to return unvaporized water from said steam drum to said water drum;

g. front and rear wall means for enclosing the respective front and rear ends of said furnace chamber and convection section;

h. means for effecting combustion within said furnace chamber whereby heat is transferred to said C-shaped tubes, to those convection tubes disposed immediately adjacent said furnace chamber and to said riser tubes, the resulting products of combustion passing via said flow passage and through said convection section wherein heat is transferred to said convection tubes; further comprising combustion products outlet means for discharging products of combustion from said convection section;

wherein the improvement comprises i. a first series of said riser tubes disposed immediately adjacent said convection section extending vertically to a first level above the upper leg portions of said C-shaped tubes, a second series of said riser tubes disposed immediately adjacent said first series extending vertically to a second level above the upper portions of said C-shaped tubes; and wherein said return conduit means connecting said riser tubes to said steam drum comprise each riser tube including a first portion extending generally horizontally toward the front end of said boiler, and a second portion extending generally horizontally in a direction transverse to said second longitudinal axis toward said steam drum and connected thereto, the first and second portions of the riser tubes in each of said first and second series being parallel to one another and of increasing length within each series in a direction away from said convection section, whereby the first and second portions of the riser tubes in each series lie in nested relationship; the second portions of the riser tubes of said first and second series being in generally vertically spaced relationship with respect to each other.

13. The water-tube boiler of claim 12 wherein said second level is below said first level, the second portions of the riser tubes of said first series being in generally overlying relationship to the second portions of the riser tubes of said second series.

14. The water-tube boiler of claim 12 wherein said feeder conduit means comprise a. a manifold disposed adjacent the rear end of said furnace chamber at a level below the lower leg portions of said C-shaped tubes and extending generally horizontally in a direction transverse to said first longitudinal axis; and b. a plurality of feeder conduits disposed below the lower leg portions of said C-shaped tubes and connected between said water drum and said manifold.

15. A water-tube boiler comprising:

a. an elongated water drum disposed at a lower level and extending generally horizontally along a first longitudinal axis, one end of said water drum being disposed adjacent a front end of said boiler, the other end being disposed adjacent a rear end thereof;

b. an elongated steam drum disposed at an upper level above said lower level and extending generally horizontally along a second longitudinal axis substantially parallel to said first longitudinal axis, said steam drum being in generally overlying relationship to said water drum;

c. a plurality of generally C-shaped tubes each having a lower leg portion connected to said water drum and extending generally horizontally therefrom in a direction transverse to said first longitudinal axis, a bight portion extending generally vertically to a level substantially equal to said upper level, and an upper leg portion extending generally horizontally in a direction transverse to said second longitudinal axis toward said steam drum and connected thereto; said plurality of C-shaped tubes being disposed in generally parallel, side-by-side relationship and including fin means interconnecting adjacent ones thereof so as to define an elongated, enclosed furnace chamber extending along a longitudinal axis generally parallel to said first and second longitudinal axes;

d. a plurality of convection tubes, each connected to and extending generally vertically between said steam drum and said water drum, said convection tubes being arranged in a two dimensional array extending along said first and second longitudinal axes and in a direction transverse thereto so as to define an elongated convection section adjacent said furnace chamber, the outermost, longitudinally extending row of said convection tubes including fin means interconnecting adjacent ones thereof so as to enclose said convection section; further comprising means for separating said convection section and said furnace chamber along a portion of their lengths while defining adjacent the rear ends thereof a flow passage therebetween;

e. structure disposed adjacent the rear end of said furnace comprising i. a manifold disposed adjacent the rear end of said furnace chamber at a level below the lower leg portions of said C-shaped tubes and extending generally horizontally in a direction transverse to said first longitudinal axis;

ii. a plurality of feeder conduits disposed below the lower leg portions of said C-shaped tubes and connected between said water drum and said manifold;

iii. a plurality of riser tubes connected to said manifold and extending generally vertically therefrom to a level above the upper leg portions of said C-shaped tubes, said riser tubes being disposed in generally parallel, side-by-side relationship and including fin means interconnecting adjacent ones thereof so as to enclose the rear end of said furnace chamber; and iv. return conduit means disposed above the upper leg portions of said C-shaped tubes connecting said riser tubes to said steam drum;

f. means for admitting water to be vaporized to said boiler for flow from said water drum into the lower leg portions of said C-shaped tubes, the lower ends of a first portion of said convection tubes and into said feeder conduits, manifold, and riser tubes, whereby at least a portion of said water is vaporized while passing through said tubes and exits therefrom into said steam drum, further comprising means for withdrawing said vaporized water from said steam drum; a second portion of said convection tubes serving as downcomers to return unvaporized water from said steam drum to said water drum;

g. front and rear wall means for enclosing the respective front and rear ends of said furnace chamber and convection section;

h. means for effecting combustion within said furnace chamber whereby heat is transferred to said C-shaped tubes, to those convection tubes disposed immediately adjacent said furnace chamber and to said riser tubes, the resulting products of combustion passing via said flow passage and through said convection section wherein heat is transferred to said convection tubes; further comprising combustion products outlet means for discharging products of combustion from said convection section;

wherein the improvement comprises i. said feeder conduits comprising at least first, second, and third feeder conduits, said second feeder conduit being longer than the first feeder conduit, and the third feeder conduit being longer than the second feeder conduit; said first, second, and third feeder conduits being connected to said manifold at respective first, second, and third adjacent points spaced along the length thereof with the distance between said first and second points being greater than the distance between said second and third points, whereby even distribution of water to said manifold and riser tubes is provided.

16. The water-tube boiler of claim 15 wherein said feeder conduits further comprise a fourth feeder conduit having a length greater than said third feeder conduit and connected to said manifold at a fourth point adjacent said third point and spaced therefrom by a distance less than the distance between said second and third points.

17. The water-tube boiler of claim 15 wherein said first, second, and third feeder conduits comprise a. said first feeder conduit including a first portion extending generally horizontally from said water drum in a direction transverse to said first longitudinal axis and a second portion extending generally horizontally in a direction parallel to said first longitudinal axis and connected to said manifold at said first point;

b. said second feeder conduit connected to said water drum at a point spaced longitudinally in the direction of said front end from said first feeder conduit and including a first portion extending generally horizontally therefrom in a direction transverse to said first longitudinal axis and a second portion extending generally horizontally in a direction parallel to said first longitudinal axis and connected to said manifold at said second point spaced in the direction away from said water drum from said first point; and c. said third feeder conduit connected to said water drum at a point spaced longitudinally in the direction of said front end from said second feeder conduit and including a first portion extending generally horizontally therefrom in a direction transverse to said first longitudinal axis, a second portion extending generally horizontally in a direction at an angle with respect to said first longitudinal axis, and a third portion extending generally horizontally in a direction parallel to said first longitudinal axis and connected to said manifold at said third point spaced in the direction away from said water drum from said second point.

18. The water-tube boiler of claim 17 further comprising a fourth feeder conduit connected to said water drum at a point spaced longitudinally in the direction of said front end from said third feeder conduit and including a first portion extending generally horizontally therefrom in a direction transverse to said first longitudinal axis, a second portion extending generally horizontally in a direction at an angle with respect to said first longitudinal axis, and a third portion extending generally horizontally in a direction parallel to said first longitudinal axis and connected to said manifold at a fourth point spaced in the direction away from said water drum from said third point by a distance less than that between said second and third points.

19. A water-tube boiler comprising:

a. an elongated water drum disposed at a lower level and extending generally horizontally along a first longitudinal axis, one end of said water drum being disposed adjacent a front end of said boiler, the other end being disposed adjacent a rear end thereof;

b. an elongated steam drum disposed at an upper level above said lower level and extending generally horizontally along a second longitudinal axis substantially parallel to said first longitudinal axis, said steam drum being in generally overlying relationship to said water drum;

c. a plurality of generally C-shaped tubes each having a lower leg portion connected to said water drum and extending generally horizontally therefrom in a direction transverse to said first longitudinal axis, a bight portion extending generally vertically to a level substantially equal to said upper level, and an upper leg portion extending generally horizontally in a direction transverse to said second longitudinal axis toward said steam drum and connected thereto; said plurality of C-shaped tubes being disposed in generally parallel, side-by-side relationship and including fin means interconnecting adjacent ones thereof so as to define an elongated, enclosed furnace chamber extending along a longitudinal axis generally parallel to said first and second longitudinal axes;

d. a plurality of convection tubes, each connected to and extending generally vertically between said steam drum and said water drum, said convection tubes being arranged in a two dimensional array extending along said first and second longitudinal axes and in a direction transverse thereto so as to define an elongated convection section adjacent said furnace chamber; the outermost longitudinally extending row of said convection tubes including fin means interconnecting adjacent ones thereof so as to enclose said convection section; further comprising means for separating said convection section and said furnace chamber along a portion of their lengths while defining adjacent the rear ends thereof a flow passage therebetween;

e. means for admitting water to be vaporized to said boiler for flow from said water drum into the lower leg portions of said C-shaped tubes and the lower ends of a first portion of said convection tubes whereby at least a portion of said water is vaporized while passing through said tubes and exits therefrom into said steam drum, further comprising means for withdrawing said vaporized water from said steam drum; a second portion of said convection tubes serving as downcomers to return unvaporized water from said steam drum to said water drum;

f. front and rear wall means for enclosing respective front and rear ends of said furnace chamber and convection section, said front wall means including a generally planar front end plate overlying and enclosing at least the front end of said convection section;

g. means for effecting combustion within said furnace chamber whereby heat is transferred to said C-shaped tubes and to those convection tubes disposed immediately adajcent said furnace chamber; the resulting products of combustion passing via said flow passage and through said convection section wherein heat is transferred to said convection tubes;

wherein the improvement comprises combustion products outlet means for discharging products of combustion from said convection section comprising h. frame means defining an opening therethrough and adapted for connection to an exhaust stack, said frame means overlying a portion of the outermost row of said convection tubes disposed adjacent the front end of said convection section and which do not include fin means interconnecting adjacent ones thereof, said frame means including a vertically extending first edge portion in sealing engagement with and at least partially supported by said generally planar front end plate; and i. sealing means for sealing the remaining edge portions of frame means with respect to said convection section.

20. The water-tube boiler of claim 19 wherein said frame means is of generally rectangular configuration and includes a vertically extending second edge portion spaced from and generally parallel to said first edge portion, said sealing means including a first plate member in sealing engagement with and supporting said second edge portion, said first plate member being in sealing engagement with and supported by fin means associated with one of said outermost convection tubes.

21. The water-tube boiler of claim 20 wherein said frame means includes generally horizontally extending third and fourth edge portions extending between respective upper and lower ends of said first and second edge portions, sealing means further comprising a second plate member extending between said front end plate and said first plate member in sealing engagement therewith, and between said third edge portion and said steam drum in sealing engagement therewith; and a third plate member extending between said front end plate and said first plate member in sealing engagement therewith, and between said fourth edge portion and said water drum in sealing engagement therewith.

* * * * *